US007460824B2

(12) United States Patent
Nakajima et al.

(10) Patent No.: US 7,460,824 B2
(45) Date of Patent: Dec. 2, 2008

(54) SHEET MOISTURIZING DEVICE AND IMAGE FORMING APPARATUS

(75) Inventors: Hirofumi Nakajima, Hachioji (JP); Teruhiko Toyoizumi, Tachikawa (JP); Hideo Yamane, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 11/826,305

(22) Filed: Jul. 13, 2007

(65) Prior Publication Data

US 2008/0044207 A1 Feb. 21, 2008

(30) Foreign Application Priority Data

Aug. 21, 2006 (JP) ..... 2006-223944

(51) Int. Cl.
*G03G 15/20* (2006.01)
*G03G 15/00* (2006.01)

(52) U.S. Cl. ..... 399/341; 399/390; 399/406

(58) Field of Classification Search ..... 347/102; 399/341, 390, 406, 407
See application file for complete search history.

(56) References Cited

U.S. PATENT DOCUMENTS 5,842,105 A * 11/1998 Acquaviva ..... 399/406
2005/0286946 A1* 12/2005 Kougami et al. ..... 399/390

FOREIGN PATENT DOCUMENTS

JP 2000-247526 9/2000
JP 2002-193524 7/2002
JP 2007057923 A * 3/2007
JP 2007065010 A * 3/2007

* cited by examiner

*Primary Examiner*—Ryan Gleitz
(74) *Attorney, Agent, or Firm*—Finnegan, Henderson, Farabow, Garrett & Dunner, L.L.P.

(57) ABSTRACT

A sheet moisturizing device, including a moisturizing section which applies water on a sheet carrying a formed image and moisturizes the sheet, a switching section which switches whether a moisturizing process is to be conducted onto the sheet by the moisturizing section or not, and a control section which controls the switching section based on image information carried on the sheet.

19 Claims, 7 Drawing Sheets

SHEET MOISTURIZING DEVICE AND IMAGE FORMING APPARATUS

FIELD OF THE INVENTION

The present invention relates to a sheet moisturizing device incorporating a moisturizing section to apply water to a sheet, and to an image forming apparatus.

BACKGROUND OF THE INVENTION

In image forming apparatuses to form images by an electro-photographic method, said apparatus forms a toner image on a sheet by using micro-powder toner, and heats and presses the toner image to permanently fix it onto the sheet.

This fixing process heats a sheet at high temperature so that any moisture included in the sheet evaporates, however since both surfaces of the sheet are not heated by the same amount of heat, different amounts of water evaporate from each surface, which is part of the reason for a curled sheet.

To overcome this problem, Unexamined Japanese Patent Application Publication No. 2000-247526 discloses a de-curling device which bends the curled sheet opposite to a curled direction. This device includes a curl-correction mechanism (which is so-called "de-curler") incorporating paired rollers and a looped space, where the de-curler is switched to be used or not, based on the characteristics or type of the supplied sheet.

Further, a dried sheet, after passing through the fixing process is introduced to the ambient environment, from which it absorbs moisture so that the amount of moisture in said sheet gradually turns to be normal. However the amount of moisture returns at various rates, and the amount of moisture differs in various sections of the sheet, which results in a waved sheet.

To overcome this problem, Unexamined Japanese Patent Application Publication No. 2002-193524 discloses a device for applying water to a sheet, which includes a water supplying container to store water, and paired moisturizing rollers to receive water stored in the water supplying container, wherein when the sheet passes between the paired rollers, the sheet is moisturized.

However, said device moisturizes every supplied sheet, whereby moisturization is conducted on the sheets which are not waved or tend to be not waved. Accordingly, water consumption increases so that an operator frequently needs to replenish water in the container, which is very bothersome.

Further, if moisturization is conducted on the sheets which are not waved or tend to be not waved, said sheets contain so much water that they become thick, and its rigidity decrease, which tend to result in erratic sheet conveyance, or after said sheets are ejected to be stacked on a sheet ejection tray, they adhere to each other, which needs to be prevented.

SUMMARY OF THE INVENTION

The present invention was achieved to overcome the above problems, and an object of the present invention is to provide a sheet moisturizing device and an image forming apparatus, wherein water consumption is decreased so that working efficiency of the operator is increased, while any waved sheets are effectively flattened.

In order to attain the above object, the sheet moisturizing device of the present invention includes:

a moisturizing section which applies water on a sheet carrying a formed image and moisturizes the sheet, a switching section which switches whether a moisturizing process is to be conducted on the sheet by the moisturizing section or not, and a control section which controls the switching section based on image information carried on the sheet.

Further, in order to attain the above object, the image forming apparatus of the present invention includes:

an image forming section which transfers toner image onto a supplied sheet to form the image, a fixing section which heats and presses the sheet carrying the image formed by the image forming section to produce a permanent image, a moisturizing section which applies water onto the sheet carrying the fixed image to moisturize the sheet, a switching section which switches whether moisturizing process is conducted or not by the moisturizing section onto the sheet, and a control section which controls the switching section based on image information carried on the sheet.

DETAILED DESCRIPTION OF THE INVENTION

Figure 1:
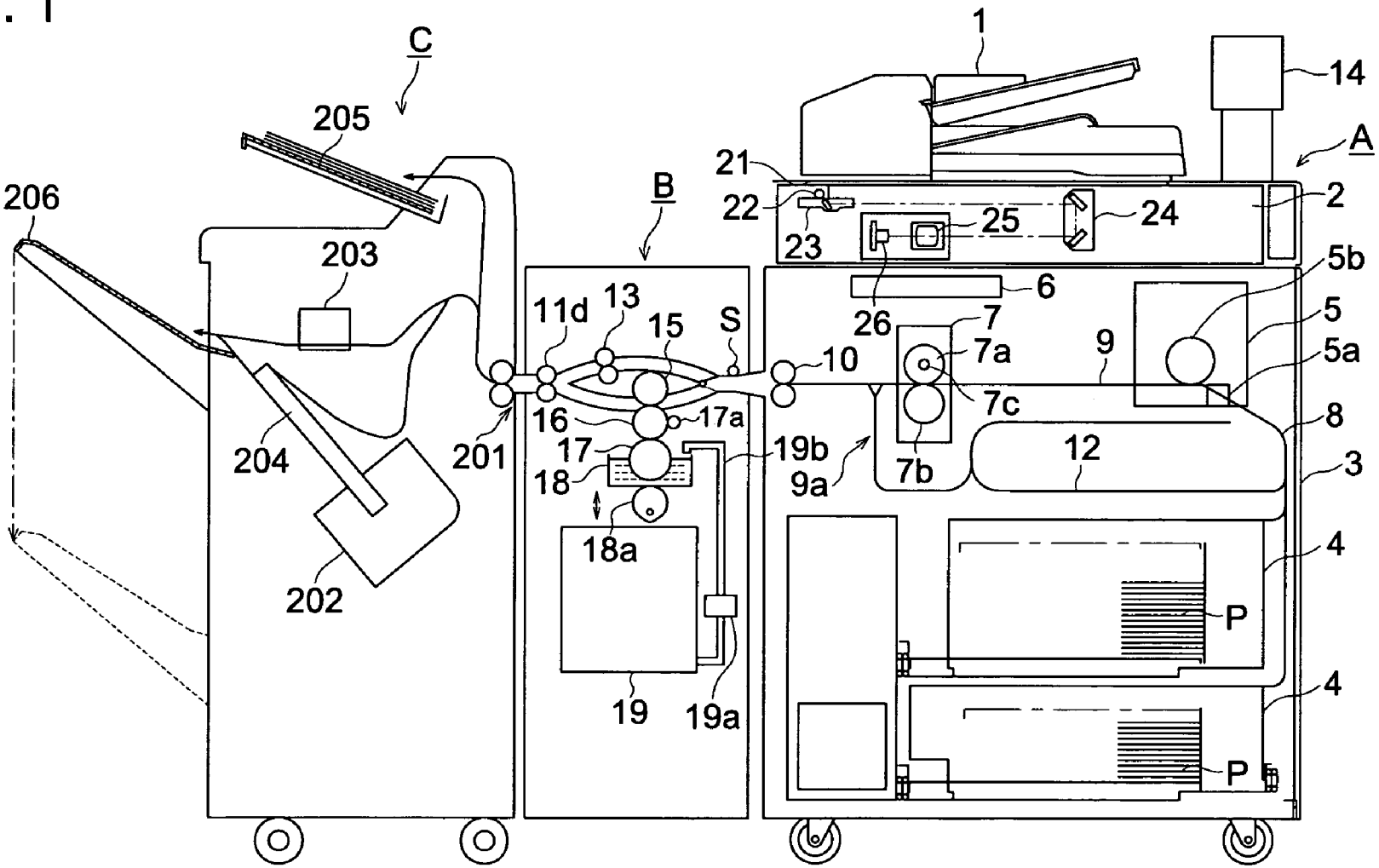
FIG. 1 is a schematic sectional view of an image forming system of the first embodiment.

Embodiments of the present invention will now be detailed while referring to the drawings, however, the descriptions explaining the embodiments does not limit the technical scope of the present invention.

First Embodiment

FIG. 1 is a schematic sectional view of the image forming system relating to the first embodiment of the present embodiment, wherein the image forming system includes image forming apparatus A, sheet moisturizing device B, and post processing device C.

Image forming apparatus A is formed of automatic document feeding device 1 and image reading section 2, both mounted on an upper section of image forming apparatus A, and printer section 3 mounted on a lower section.

Image reading section 2, mounted under platen glass 21, is formed of light source 22, mirror unit 23 having a first mirror, a V-mirror unit having second and third mirrors, lens 25, and CCD image sensor 26. When a document, which is not illustrated, is conveyed onto platen glass 21 by automatic document feeding device 1, the document is irradiated by light source 22. Light reflected from the document is concentrated on CCD image sensor 26 through mirror unit 23, V-mirror unit 24 and lens 25, whereby light is converted to electrical signals. These electrical signals are processed by image processing section 6, and are stored as digital image data in RAM 302, which will be detailed later.

Printer section 3 includes sheet accommodating section 4, image forming section 5, image processing section 6 and image fixing section. Image forming section 5 forms toner images on photoconductor 5*b* by an electro-photographic process to conduct electrical charge, exposure and development. Image fixing section forms a nip section which nips sheet P by heating roller 7*a* accommodating heat source 7*c* and pressure roller 7*b*, and conveys sheet P while heating it and pressing to melt toner particles and fixes images onto sheet P.

Sheet P, supplied from sheet accommodating section 4, is temporarily stopped on supply-conveyance section 5*a* of image forming section 5, and is again conveyed by supply-conveyance section 5*a* of image forming section 5. The toner image formed on photoconductor 5*b* is then transferred onto sheet P. After image fixing section 7 fixes the transferred toner particles of the image on sheet P, the sheet is then ejected by paired ejection rollers 10.

Conveyance paths of sheet P include sheet supplying path 8 which is from sheet accommodating section 4 to image forming section 5, conveyance path 9 which is from image forming section 5 to paired ejection rollers 10 passing through image fixing section, and sheet reversing path 12 which reverses sheet P to be conveyed in a reversed orientation.

Image forming mode includes a single-side face-down ejection mode, a single-side face-up ejection mode, and a double-side mode.

In the single-side face-down ejection mode, after the image is formed on one surface of sheet P by image forming section 5, sheet P passes through image fixing section 7 to have the image fixed, and then sheet P is reversed by switch-back path 9*a*, and is ejected by paired ejection rollers 10.

In the single-side face-up ejection mode, after the image is formed on a single surface of sheet P by image forming section 5, sheet P passes through image fixing section 7 to have the image fixed, after which sheet P is ejected by paired ejection rollers 10.

In the double-side mode, after the image is formed on a first surface of sheet P, sheet P passes through image fixing section to have its image fixed, after which the same sheet P is conveyed through reversing conveyance path 12 to be reversed, and is again conveyed to sheet supplying path 8. Next, image formation is conducted on the reversed surface of sheet P by image forming section 5, after which sheet P passes through image fixing section 7 to have the image fixed. Sheet P, carrying an image on both surfaces, is then ejected by paired ejection rollers 10.

An operator can select one of the various operation modes of image forming apparatus A and also can set an output mode to be used by post-processing device C by operation section 14, which is provided on image forming apparatus A.

Sheet P, ejected from image forming apparatus A, is conveyed to post-processing device C through sheet moisturizing device B, which will be detailed later.

Post-processing device C includes stapling section 202, shifting section 203, intermediate stacker 204 and elevating ejection tray 206. After well known stapling process or shift process is conducted on Sheet P which was conveyed from entrance 201, sheet P is ejected onto elevating ejection tray 206. Post-processing device C, further including unmovable sheet ejection tray 205, ejects sheets P which were conveyed from entrance 201, to unmovable sheet ejection tray 205 in the case of a small amount of image formation. Further, when the mode is used in which stapling or shifting process is not to be conducted, sheet P is ejected directly onto elevating ejection tray 206 in the case of large amount of image formation.

Figure 2:
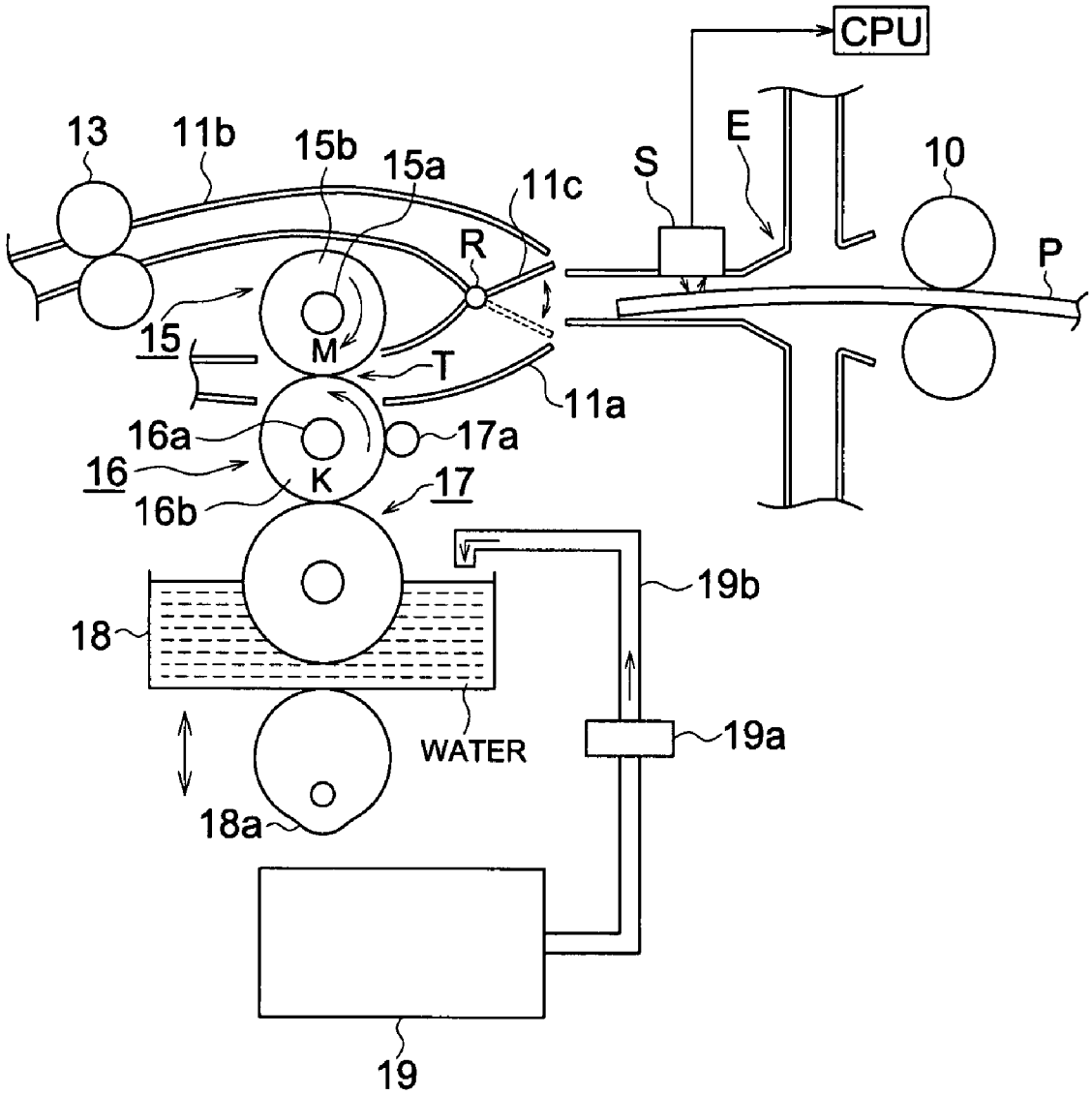
FIG. 2 is an enlarged sectional view of a portion of the first and second conveyance paths of the sheet moisturizing device shown in FIG. 1.

FIG. 2 is an enlarged view of a portion of first and second conveyance paths of sheet moisturizing device B which is also shown in FIG. 1.

In FIGS. 1 and 2, sheet moisturizing device B includes first conveyance path 11*a*, and second conveyance path 11*b*, which is mounted above first conveyance path 11*a*. First conveyance path 11*a* includes paired moisturizing rollers 15 and 16 serving as a moisturizing section. Second conveyance path 11*b*, serving as a by-pass of first conveyance path 11*a*, includes paired conveyance rollers 13. Since second conveyance path 11*b* is provided above first conveyance path 11*a*, water supplying roller 17 and water supplying tank 18, which will be detailed later, can be mounted under first conveyance path 11*a*, for simpler mechanism to supply water to paired moisturizing rollers 15 and 16.

At a branching point of first and second conveyance paths 11*a* and 11*b*, sheet switching plate 11*c* is provided to switch conveyance direction of sheet P, sheet switching plate 11*c* pivots on shaft R, and is driven by a spring and a solenoid, neither of which are illustrated. Sheet switching plate 11*c* is controlled based on image information formed on sheet P, which will be detailed later, so that the appropriate conveyance path for sheet P, ejected from image forming apparatus A by sheet ejection roller 10, is selected from either first conveyance path 11*a* or second conveyance path 11*b*, respectively.

When the solenoid is not energized, sheet switching plate 11*c* is pulled by spring force to the position shown by the solid lines in FIG. 2 so that first conveyance path 11*a* is open, that is, a so-called "default setting" is formed. Further, the length of first conveyance path 11*a* is equal to that of second conveyance path 11*b*, which simplifies the sheet conveyance sequence. Sheet detector S is mounted near sheet entrance E of sheet moisturizing device B, and detects the leading edge of sheet P, ejected by paired sheet ejection rollers 10.

Paired moisturizing rollers 15 and 16 are formed of porous layers 15*b* and 16*b*, both being porous polyurethane rubber, which are formed on rigid shaft 15*a* and 16*a*, being metal or hard resin. Porous layers 15*b* and 16*b* receive water on their surfaces, and rotate in the directions indicated by arrows M and K. Moisturizing roller 15 is forced against moisturizing roller 16 by a pressuring mechanism until moisturizing roller 15 touches a stopper, whose structure will be detailed later, whereby both rollers 15 and 16 form nip section T which nips sheet P to be moisturized during conveyance.

Other than starting rotation, water supplying roller 17 is separated from moisturizing roller 16. Since it is necessary for moisturizing roller 16 to receive water exactly when it starts rotation, water supplying tank 18 incorporating water supplying roller 17 is driven upward by eccentric cam 18*a*, whereby water supplying roller 17 comes into contact with moisturizing roller 16 to apply water. Water supplying roller 17 is formed of a material of porous polyurethane rubber, a portion of which is below the surface of the water. Water is supplied from water storage tank 19 to water supplying tank 18 through pump 19*a* and water pipe 19*b*, so that an adequate water level is always maintained. In the present embodiment, a water supplying section is represented by water supplying roller 17, water supplying tank 18, water storage tank 19, pump 19*a* and water pipe 19*b*. Further, the moisturizing section is represented by said water supplying section and paired moisturizing rollers 15 and 16.

Water squeezing member 17*a*, structured of a round bar of metal or hard resin, is provided to contact moisturizing roller 16, and is pressure-contacted with porous layer 16*b* of moisturizing roller 16, whereby porous layer 16*b* is distorted to remove some of the water. Accordingly, water content of moisturizing roller 16 and water amount to be applied to sheet P are controlled so that sheet P is appropriately moisturized, and further, excessive moisturization of sheet P is prevented so that sheets P are not adhered to each other. That is, by adjusting the contact pressure of squeezing member 17*b* against moisturizing roller 16, sheet P can be appropriately moisturized. In addition, squeezing roller 17*a* may be driven by moisturizing roller 16, or may not be driven by it but pressure-contacted, either method may be used. Further, it is possible to change amount of water supplied to the sheet P by changing the rotation speed of moisturizing roller 16. Still further, it is possible to change amount of water supplied to the sheet P by changing the superficial dimension of water supplying roller 17 emerging from the water.

Figure 3:
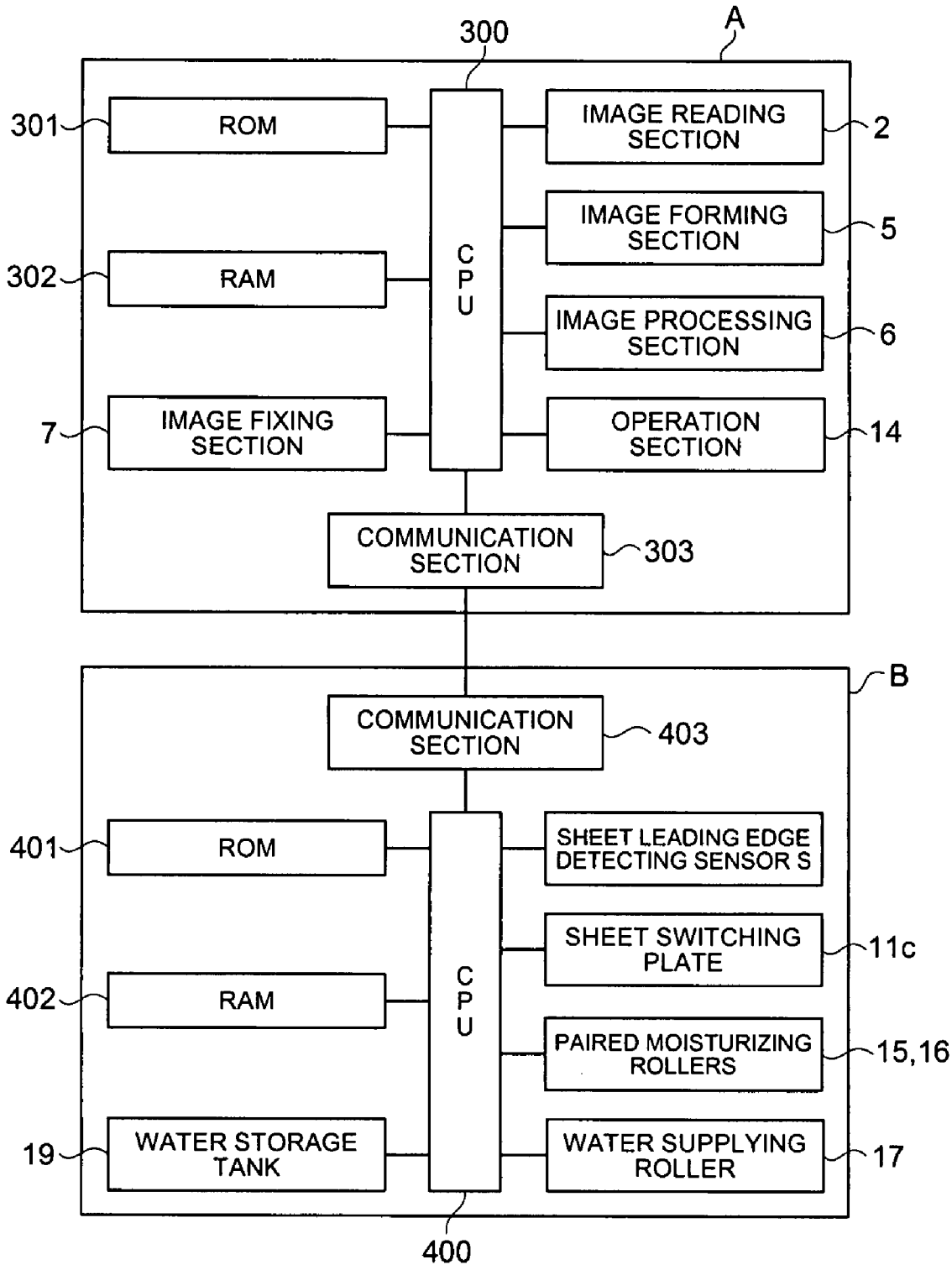
FIG. 3 is a block diagram of a control system of the image forming system and the sheet moisturizing device.

FIG. 3 is a block diagram of a control system of image forming apparatus A and sheet moisturizing device B, whereby a typical example is shown. Image forming apparatus A includes image reading section 2, image forming section 5, image processing section 6, image fixing section 7, operation section 14, ROM 301, RAM 302, communication section 303 and CPU 300 to control them. The functions have been detailed above for image reading section 2, image forming section 5, image processing section 6, image fixing section 7, which will not be repeated here.

Operation section 14 includes input devices such as a key board and a mouse, and the operator uses the input devices to set various modes of image forming apparatus A and an output mode of post-processing device C. In the present embodiment, it is possible to set from the operation section 14 whether moisturizing process is carried out or not according to a kind of sheet P such as new paper, OHP sheet, resin coating paper and re-used paper.

In detail, whether the moisturizing process is carried out or not may be set directly from the operation section 14. It is also possible that when a kind of sheet P is inputted from operation 14, the CPU 300 decides whether the moisturizing process is carried out or not with reference to the information which had been stored in RAM 302 and which relates a kind of sheet P to implement or not of the moisturizing process.

In the present embodiment, judging whether the moisturizing process based on a kind of sheet P may be omitted.

In the present embodiment, sheet switching plate 11*c* is controlled based on image information formed on sheet P which will be described later. Additionally, threshold levels to be used for this control can be inputted by the operator to be stored in RAM 302. Further, operation section 14 has a display function such as a liquid crystal screen, to display various setting information, a touch panel having a display function and an input function can be preferably structured.

ROM 301 stores control programs for CPU 300 to control each section.

RAM 302 serves as a temporal storing section, wherein after CPU 300 reads out a control program for each operation, said each program is temporally stored in RAM 302 for processing the operation. Further RAM 302 stores various setting information and the threshold levels, both inputted via operation section 14.

Communication section 303 is an interface for transmitting information, and connected to communication section 403 of sheet moisturizing device B, via USB (being Universal Serial Bus), and IEEE (Institute of Electrical and Electronic Engineers) 1394.

Sheet moisturizing device B includes sheet leading edge sensor S, sheet switching plate 11*c*, paired moisturizing rollers 15 and 16, water supplying roller 17, water storage tank 19, ROM 401, RAM 402, communication section 403 and CPU 400 which controls these sections. CPU 400 controls sheet switching plate 11*c*, paired moisturizing rollers 15 and 16, and water supplying roller 17, based on the control programs stored in ROM 401, and transmits a detected result of sheet leading edge sensor S to CPU 300, via communication section 403, and communication section 303. In the present embodiment, CPU 300 is provided in image forming section 403, and CPU 400 is provided in sheet moisturizing device B, but it is possible to provide one CPU to control both image forming section 403 and sheet moisturizing device B.

In the present embodiment, the control section is represented by image reading section 2, image processing section 6, CPU 300, RAM 302 and CPU 400.

Figure 4:
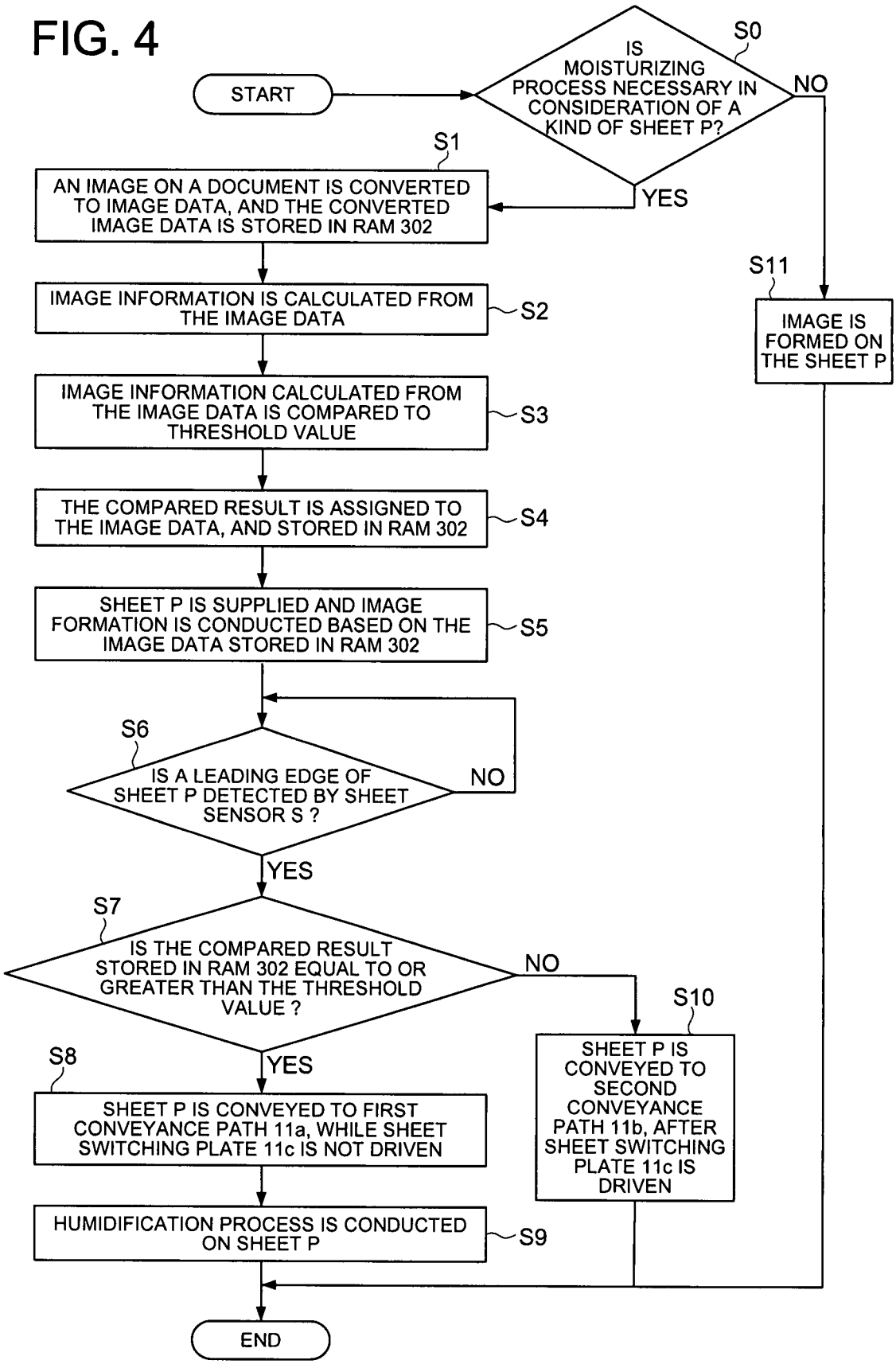
FIG. 4 is a flow chart of forming the images on the sheet and of moisturizing the sheet carrying the formed image.

FIG. 4 is a flow chart in which image formation is conducted on sheet P, and sheet P is moisturized. In the present embodiment, in order to control the water consumption, unwaved or barely un-waved sheets P, for instance resin coated paper, are ejected without moisturization, and only waved sheets P are moisturized. In step 0, whether moisturizing process is necessary or not based on a kind of sheet P is confirmed. If CPU300 recognizes the moisturizing process is not necessary (in step 0, no), the images are formed on the sheet P (Step 11) and flow ends. If CPU recognizes the process is necessary based on a kind of sheet P, the flow proceeds Step 1. In this flow, the information of implementing the moisturizing process or not is set from the operation section 14.

Then, whether sheets P will be waved or not can be judged based on image information formed on sheet P, accordingly, in the processing flow described below, the present embodiment is structured to control whether the moisturization is to be conducted on sheet P, based on said image information.

Initially, the document is conveyed by automatic document feeding device 1, and is radiated by light source 22. The reflected light from the document is converted to electrical signals at CCD image sensor 26, which are stored in RAM 302 as digital image data (step S1). At the same time, the image data stored in RAM 302 is analyzed and image information is calculated (step S2). For example, image information includes: ratio of the dimension of the toner image to the dimension of sheet P, which is a ratio of sheet P covered by toner (which is a ratio of the dimension of the image), and the maximum dimension of solid images evenly formed on sheet P.

Next, said calculated image information is judged whether it is equal to or greater than the threshold value stored in RAM 302 (step S3). In detail, if an image dimension ratio is used for image information, the threshold value is 90%. If the maximum dimensions of the images evenly formed on all over sheet P is used for image information, the threshold value is 4 cm×4 cm, whereby whether calculated image information is equal to or greater than the threshold value is judged. This threshold value can be appropriately set, based on temperature or humidity of the room where the image forming system is installed, the fixing temperature in fixing section 7, and the degree of waving on the sheet, which can be set by the operator via operation section 14, and stored in RAM 302. The judged result obtained in step 3 is paired to the image data, which are stored in RAM 302 (step S4). For example, if image information is equal to or greater than the threshold value, "1", and if it is less than the threshold value, "0" is assigned onto the image data, as flag information.

After toner image is formed on-photo-conductor 5*b* based on the image data stored in RAM 302, sheet P is supplied to image forming section 5 (see FIG. 1), and said toner image is transferred onto sheet P to form the image (step S5). After sheet P carrying the formed image passes trough fixing section 7, and sheet P carrying a permanent image is ejected by paired ejection rollers 10, and is introduced to sheet entrance E of sheet moisturizing device B (see FIG. 2). After the leading edge of sheet P is detected by sheet leading edge sensor S (Yes in step S6), said detected result is transmitted to CPU 300 through communication section 403 and communication section 303.

CPU 300 retrieves a compared result (which is flag information) assigned to the image data, and sends the compared result to CPU 400. As the compared result, if image information is equal to or greater than the threshold value (being flag "1") (Yes in step S7), CPU 400 does not activate sheet switching plate 11*c,* and conveys sheet P to first conveyance path 11*a* (step 8). Sheet P is then nipped and conveyed at nip section T by paired moisturizing rollers 15 and 16, so that sheet P is moisturized (step S9), and the operation flow is completed. On the other hand, if image information is less than the threshold value (being flag "0") (No in step S7), CPU 400 activates sheet switching plate 11*c,* and conveys sheet P to second conveyance path 11*b* (step 10). Due to this, sheet P is ejected without moisturized.

As detailed above, sheet P is judged whether to be moisturized or not, based on image information (which is the ratio of the image dimension, or the maximum dimension of the evenly formed image), and based of said judgment, the conveyance path of sheet P is structured to be selected from the conveyance path having the moisturization function and the conveyance path having no moisturization function. Accordingly, the moisturization is conducted for waved sheet P, but is not conducted for non-waved sheet P, due to this, unnecessary moisturization is avoided from sheet P, which results in appropriate water consumption, and higher working efficiencies of the operator.

In the above explanation, switching timing of sheet switching plate 11*c* is controlled based on the detection of sheet leading edge sensor S, but it is also possible in this embodiment that switching timing is controlled based on the time duration of sheet P conveyed from supply-conveyance section 5*a* of image forming section 5.

Further, in the above embodiment, the moisturization or non-moisturization of sheet P is selected by the change of conveyance path, however it is also possible to select it without changing the conveyance path, which will be detailed below.

Second Embodiment

Figure 5:
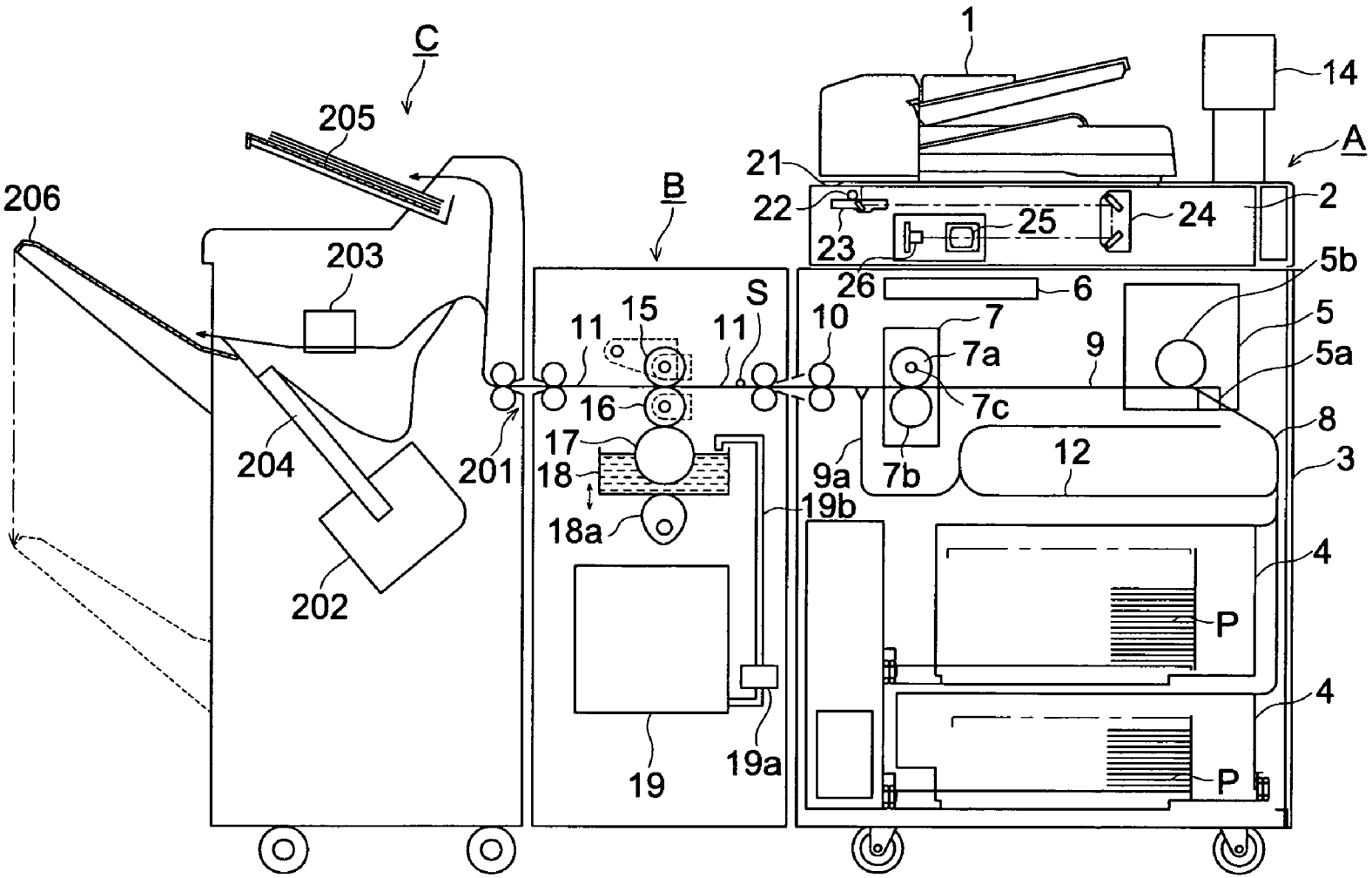
FIG. 5 is a schematic sectional view of an image forming system of a second embodiment.

FIG. 5 is a schematic sectional view of an image forming system of the second embodiment. The image forming system includes image forming apparatus A, sheet moisturizing device B and post processing device C. Since image forming apparatus A and post processing device C in the second embodiment have the same functions as those of the first embodiment respectively, the explanations of them are neglected, while using the same numbers as those of the first embodiment.

Figure 6:
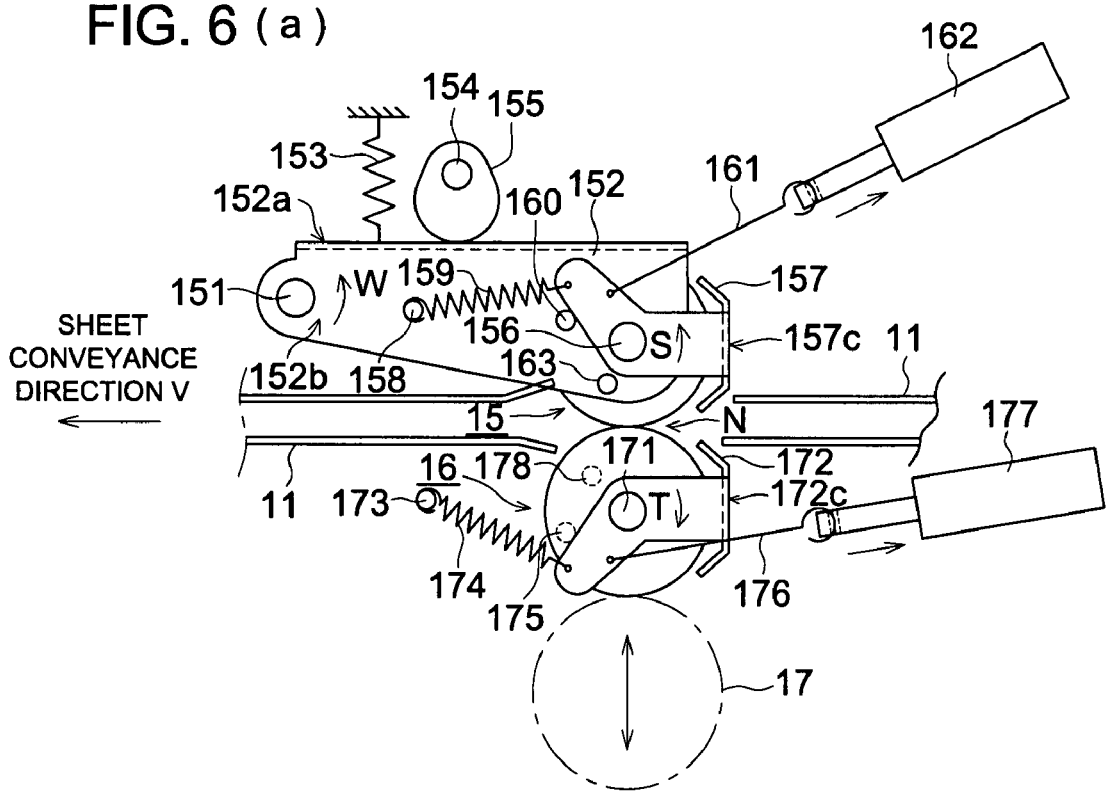
FIG. 6 is an enlarged view of a vicinity of a moisturizing roller of the sheet moisturizing device of FIG. 5, wherein in FIG. 6(*a*), moisturizing roller 15 is pressed against moisturizing roller 16 to form a nipping section at its lowest position, while in FIG. 6(*b*), moisturizing roller 15 is at its highest position, and is separated from moisturizing roller 16 to form a space, while a pair of sheet conveyance sub-guide members enter the space to form a sheet conveyance guide.
Figure 6:
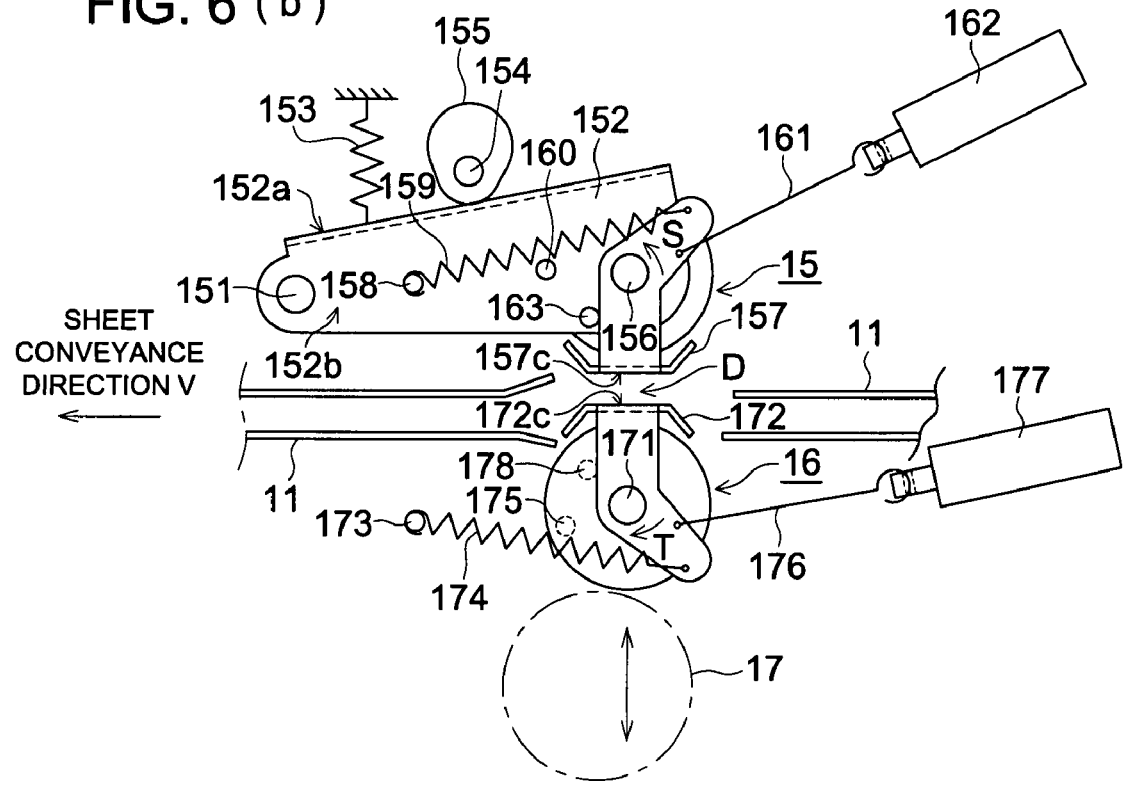

FIG. 6 is an enlarged view of a vicinity of paired moisturizing rollers 15 and 16 of the sheet moisturizing device of FIG. 5., In FIG. 6(*a*), moisturizing roller 15 is pressed against moisturizing roller 16 to form a nipping section at its lowest position, while in FIG. 6(*b*), pivot 156. Sub-guide 157 is forced to rotate in arrowed direction S by spring 159, but is stopped by stopper 160 mounted on side section 152*b.* When moisturizing roller 15 is pushed down by eccentric cam 155 to be in pressure contact with moisturizing roller 16, nipping section N is created [see FIG. 6(*a*)], whereby guide surface 157*c* is approximately vertical to sheet conveyance direction V (which is a sheet moisturization condition).

Solenoid 162 is mounted on an un-illustrated body of the moisturizing device, which turns sub-guide 157 in a counter direction of arrow S via wire 161. To separate moisturizing roller 15 from moisturizing roller 16, eccentric cam 155 turns as shown in FIG. 6(*b*), and spring 153 pulls supporting bracket 152 to allow it to turn in arrow direction W shown in FIG. 6(*a*), whereby both rollers separate each other, to create a predetermined clearance. Simultaneously, solenoid 162 is energized to turn sub-guide 157 in a counter direction of arrow S via wire 161. Stopper 163 is mounted on side section 152*b,* which stops turning of sub-guide 157. Accordingly, guide surface 157*c* is positioned to be approximately parallel to sheet conveyance direction V.

Both ends of pivot 171 of moisturizing roller 16 are supported by bearings, which are not illustrated, so that moisturizing roller 16 can be rotated by a power source, which is not illustrated. Further, sheet conveyance sub-guide 172 (hereinafter referred to as "sub-guide 172") is provided to turn about pivot 171 in arrow direction T or its counter direction.

Hanger 173 is mounted on an un-illustrated body, supporting pivot 171, of the moisturizing device, on which moisturizing roller 15 is at its highest position, and is separated from moisturizing roller 16 to form a space. A pair of sheet conveyance sub-guide members enter the space to form a sheet conveyance guide.

Figure 7:
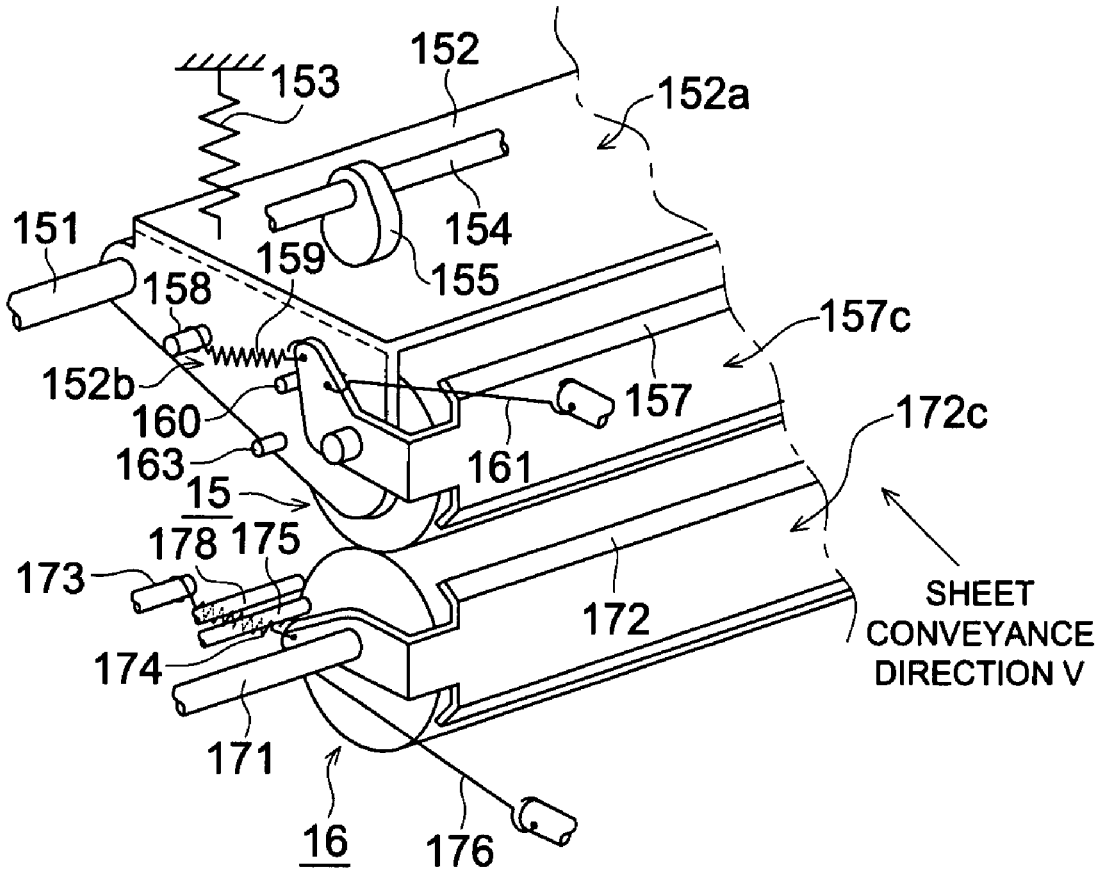
FIG. 7 is a perspective view of a vicinity of an end of paired moisturizing rollers in FIG. 6.

FIG. 7 is a perspective view of a vicinity of an end of paired moisturizing rollers 15 and 16 in FIG. 6.

In FIGS. 5, 6 and 7, paired moisturizing rollers 15 and 16, being porous, are mounted to apply water to sheet P in conveyance path 11 of sheet moisturizing device B. In FIGS. 6(*a*) and 6(*b*), pivot 151 is supported by a frame, which is not illustrated, of sheet moisturizing device B. Side sections 152*b* provided on both surface of supporting bracket 152 are turned in arrow direction W or its counter direction about pivot 151. Moisturizing roller 15 is turned about pivot 156 supported on side sections 152*b.* On top surface 152*a* of supporting bracket 152, one end of spring 153 is assembled to pull supporting bracket 152, while eccentric cam 155, which is unitary with pivot 154, is in pressure-contact with top surface 152*a.* Eccentric cam 155 is rotatable, driven by an un-illustrated drive section. That is, by the functions of pivot 151, supporting bracket 152, spring 153, pivot 154 and eccentric cam 155, moisturizing roller 15 can vertically move, which represent a switching section of the present embodiment. Further, sheet conveyance sub-guide member 157 (hereinafter referred to as "sub-guide 157") is also turned about pivot 156 of moisturizing roller 15.

Hanger 158 is mounted on side section 152*b* of supporting bracket 152, on which one end of spring 159 is hooked, while another end is hooked on one end of sub-guide 157, which is an opposite side of guide surface 157*c,* beyond one end of spring 174 is hooked, while another end is hooked on one end of sub-guide 172, which is an opposite side of guide surface 172*c,* beyond pivot 171. Sub-guide 172 is forced to rotate in arrowed direction T by spring 174, but is stopped by stopper 175, mounted on the un-illustrated body of the moisturizing device. When moisturizing roller 15 is in pressure contact with moisturizing roller 16, nipping section N is created, whereby guide surface 172*c* of sub-guide 172 is approximately vertical to sheet conveyance direction V (which is a sheet moisturization condition).

Solenoid 177 is mounted on an un-illustrated body of the moisturizing device, which turns sub-guide 172 in a counter direction of arrow T via wire 176. As shown in FIG. 6(*b*), synchronizing with formation of a clearance between moisturizing roller 15 and moisturizing roller 16, solenoid 177 is energized to turn sub-guide 172 in a counter direction of arrow T via wire 176. Stopper 178 is mounted on the un-illustrated body of the moisturizing device, which stops turning of sub-guide 172. Accordingly, guide surface 172*c* of sub-guide 172 is positioned to be approximately parallel to sheet conveyance direction V.

That is, if no moisturizing process is to be conducted on sheet P, solenoids 162 and 177 are energized, whereby guide surfaces 157*c* and 172*c* of sub-guides 157 and 172 are shifted to the space which is created by the separation of moisturizing roller 15 from moisturizing roller 16, and sheet conveyance guide D (being a sub-conveyance path) is formed. Accordingly, moisturizing rollers 15 and 16 do not touch sheet P, resulting no moisturizing process onto sheet P.

If the moisturizing process is to be conducted on sheet P, solenoids 162 and 177 are deactivated, whereby sub-guides 157 and 172 are turned by springs 159 and 174 in the directions shown by arrows S and T, which become vertical to sheet conveyance direction V, and cam 155 is turned so that moisturizing roller 15 is lowered, whereby nipping section N is formed by moisturizing rollers 15 and 16.

By the above structure employing a single conveyance path, the moisturizing process and the non-moisturizing process can be switched, which simplifies the sequence of software for the conveyance of the sheet, and the sheet can be more stably conveyed.

In addition, pivot 171 of moisturizing roller 16 is supported to be fixed in the present embodiment. However, it is possible to use a structure in which the same structure as moisturizing roller 15 is used, that is, pivot 171 of moisturizing roller 16 is supported by supporting bracket 152 which is driven by eccentric cam 155, and moisturizing roller 16 is shifted vertically in conjunction with moisturizing roller 15.

Concerning the effects of the present invention, waving generated on the sheet is effectively corrected, water consumption is controlled, and the working efficiency of the operator increases.

What is claimed is:

1. A sheet moisturizing device, comprising:

a moisturizing section which conducts a moisturizing process by applying water on a sheet carrying a formed image to moisturize the sheet;

a first conveyance path on which the moisturizing section is mounted;

a second conveyance path which serves as a bypass of the first conveyance path;

a switching section which switches a conveyance path between the first conveyance path and the second conveyance path to control whether the moisturizing process is conducted on the sheet; and a control section which controls the switching section based on image information carried on the sheet.

2. The sheet moisturizing device of claim 1, wherein the image information includes a ratio of dimensions of a formed toner image to dimensions of the sheet.

3. The sheet moisturizing device of claim 1, wherein the image information includes a maximum dimension of solid images formed on the sheet.

4. The sheet moisturizing device of claim 1, wherein the control section controls the switching section based on sheet information and the image information carried on the sheet.

5. A sheet moisturizing device comprising:

a moisturizing section which conducts a moisturizing process by applying water on a sheet carrying a formed image to moisturize the sheet, wherein the moisturizing section forms a nipping section and includes:

paired moisturizing rollers which nip the sheet to moisturize the sheet; and a water supplying section which supplies water to at least one of the paired moisturizing rollers;

a switching section configured to selectively change a position of at least one of the paired moisturizing rollers to release the nipping section and control whether the moisturizing process is conducted on the sheet; and a control section which controls the switching section based on image information carried on the sheet.

6. The sheet moisturizing device of claim 5, wherein the water supplying section includes a water supplying roller, wherein an amount of water to be applied onto the sheet is controlled based on a rotation speed of the water supplying roller.

7. The sheet moisturizing device of claim 6, wherein the amount of water to be applied onto the sheet is controlled based on a superficial dimension of the water supplying roller emerging on the water.

8. The sheet moisturizing device of claim 6, wherein the water supplying section includes an eccentric cam which changes a superficial dimension of the water supplying roller emerging on the water.

9. An image forming apparatus, comprising:

an image forming section which transfers toner image onto a sheet;

a fixing section which heats and presses the sheet carrying an image formed by the image forming section to produce a fixed image;

a moisturizing section which conducts a moisturizing process by applying water onto the sheet carrying the fixed image;

a first conveyance path on which the moisturizing section is mounted;

a second conveyance path which serves as a bypass of the first conveyance path;

a switching section which switches a conveyance path between the first conveyance path and the second conveyance path to control whether the moisturizing process is conducted on the sheet; and a control section which controls the switching section based on image information carried on the sheet.

10. An image forming apparatus comprising:

an image forming section which transfers toner image onto a sheet;

a fixing section which heats and presses the sheet carrying an image formed by the image forming section to produce a fixed image;

a moisturizing section which conducts a moisturizing process by applying water onto the sheet carrying the fixed image to moisturize the sheet, wherein the moisturizing section forms a nipping section and includes:

paired moisturizing rollers which nip the sheet to moisturize the sheet; and a water supplying section which supplies water to at least one of the paired moisturizing rollers;

a switching section configured to selectively change a position of at least one of the paired moisturizing rollers to release the nipping section and control whether the moisturizing process is conducted on the sheet; and a control section which controls the switching section based on image information carried on the sheet.

11. The image forming apparatus of claim 10, wherein the water supplying section includes a water supplying roller, wherein an amount of water to be applied onto the sheet is controlled based on the rotation speed of the water supplying roller.

12. The image forming apparatus of claim 11, wherein the amount of water to be applied onto the sheet is controlled based on a superficial dimension of the water supplying roller emerging on the water.

13. The image forming apparatus of claim 11, wherein the water supplying section includes an eccentric cam which changes a superficial dimension of the water supplying roller emerging on the water.

14. The image forming apparatus of claim 9, wherein the image information includes a ratio of dimensions of a formed toner image to dimensions of the sheet.

15. The image forming apparatus of claim 9, wherein the control section controls the switching section based on sheet information and the image information carried on the sheet.

16. The image forming apparatus of claim 15, wherein the sheet information includes types of the sheet.

17. The image forming apparatus of claim 9, wherein the image information includes a maximum dimension of solid images formed on the sheet.

18. The image forming apparatus of claim 10, wherein the control section controls the switching section based on sheet information and the image information carried on the sheet.

19. The image forming apparatus of claim 18, wherein the sheet information includes types of the sheet.

* * * * *